US008591181B2

(12) United States Patent
Kasibhotla et al.

(10) Patent No.: US 8,591,181 B2
(45) Date of Patent: Nov. 26, 2013

(54) TURBOMACHINE SEAL ASSEMBLY

(75) Inventors: Ravi Shankar Venkata Kasibhotla, Andhra Pradesh (IN); William Edward Adis, Scotia, NY (US); Venkata Siva Jagadeeswararao Anjuri, Andhra Pradesh (IN); Anantha Padmanabhan Bhagavatheeswaran, Karnataka (IN)

(73) Assignee: General Electric Company, Schenectady, NY (US)

( * ) Notice: Subject to any disclaimer, the term of this patent is extended or adjusted under 35 U.S.C. 154(b) by 581 days.

(21) Appl. No.: 12/906,585

(22) Filed: Oct. 18, 2010

(65) Prior Publication Data

US 2012/0093633 A1 Apr. 19, 2012

(51) Int. Cl.
*F01D 11/02* (2006.01)

(52) U.S. Cl.
USPC ..... 415/174.5; 415/173.5

(58) Field of Classification Search
USPC ..... 415/173.5, 174.4, 174.5; 277/411, 412, 277/418, 419
See application file for complete search history.

(56) References Cited

U.S. PATENT DOCUMENTS

| | | | | |
|---|---|---|---|---|
| 1,831,242 | A * | 11/1931 | Hanzlik | 277/418 |
| 3,519,277 | A | 7/1970 | Crocker | |
| 3,795,386 | A | 3/1974 | Carter et al. | |
| 4,084,825 | A | 4/1978 | Ludwig | |
| 5,222,742 | A * | 6/1993 | Roberts | 277/420 |
| 5,244,216 | A * | 9/1993 | Rhode | 277/303 |
| 5,343,697 | A * | 9/1994 | Johnson et al. | 60/226.3 |
| 5,735,667 | A | 4/1998 | Sanders et al. | |
| 6,969,231 | B2 * | 11/2005 | Ghasripoor et al. | 415/173.4 |
| 7,430,802 | B2 * | 10/2008 | Tiemann | 29/889.22 |
| 7,828,297 | B2 * | 11/2010 | Hoebel et al. | 277/412 |
| 8,066,475 | B2 | 11/2011 | Bulgrin et al. | |
| 8,215,914 | B2 | 7/2012 | Danescu et al. | |
| 8,333,544 | B1 * | 12/2012 | Pelfrey | 415/1 |
| 8,388,310 | B1 * | 3/2013 | Diakunchak | 415/173.7 |
| 8,393,859 | B1 * | 3/2013 | Dillon | 415/173.5 |
| 2011/0123378 | A1 | 5/2011 | Kothnur et al. | |
| 2011/0163505 | A1 | 7/2011 | Bhagavatheeswaran et al. | |
| 2012/0093633 | A1 | 4/2012 | Kasibhotla et al. | |

FOREIGN PATENT DOCUMENTS

| | | | |
|---|---|---|---|
| JP | 110280679 | A | 10/1999 |

* cited by examiner

*Primary Examiner* — Edward Look
*Assistant Examiner* — Liam McDowell
(74) *Attorney, Agent, or Firm* — Cantor Colburn LLP

(57) ABSTRACT

A turbomachine seal assembly includes a plurality of sealing strips configured and disposed to inhibit a flow of fluid from passing through a channel defined by a first member and a second member. At least one of the plurality of sealing strips includes a paddle element that is configured and disposed to create a fluid recirculation zone at the channel. The fluid recirculation zone further inhibits the flow of fluid through the channel.

20 Claims, 5 Drawing Sheets

TURBOMACHINE SEAL ASSEMBLY

BACKGROUND OF THE INVENTION

The subject matter disclosed herein relates to the art of turbomachines and, more particularly, to a seal assembly that inhibits fluid flow in a turbomachine.

In a typical gas turbomachine, combustors receive a supply of pressurized air from a compressor section and a supply of fuel. The pressurized air and fuel are mixed to form a combustible air/fuel mixture. The air/fuel mixture is then ignited and combusted to form hot gases that are directed into a turbine section. Thermal energy from the hot gases is converted to mechanical, rotational energy in the turbine section.

The hot gases are passed from the combustor into the turbine section through a transition duct or piece. Generally, an air duct that delivers cooling air from the compressor surrounds the transition piece. Unless internal surfaces are properly sealed, the hot gases may bypass the turbine section and enter into the air duct. This bypass or leakage flow does not produce any work and thus represent internal loses in the turbomachine. The leakage flow generally passes between adjacent surfaces moving or rotating at variable speeds. Over time, clearances between the variable speed surfaces may increase due to internal rubbing, solid particle erosion, foreign object damage (FOD), and the like. Presently, many turbomachines employ labyrinth seals between the variable speed surfaces to limit the leakage flow. The labyrinth seals create multiple barriers that substantially limit the hot gases from entering into the cooling air flow in the air duct.

BRIEF DESCRIPTION OF THE INVENTION

According to one aspect of the invention, a turbomachine seal assembly includes a plurality of sealing strips configured and disposed to inhibit a flow of fluid from passing through a channel defined by a first member and a second member. At least one of the plurality of sealing strips includes a paddle element that is configured and disposed to create a fluid recirculation zone at the channel. The fluid recirculation zone further inhibits the flow of fluid through the channel.

According to another aspect of the invention, a turbomachine includes a first member, a second member arranged proximate to the first member, a channel extending between and defined by the first member and the second member, and a seal assembly mounted to one of the first member and the second member in the channel. The seal assembly includes a plurality of sealing strips that extend toward the other of the first member and the second member. The plurality of sealing strips inhibit a flow of fluid passing through the channel. At least one of the plurality of sealing strips includes a paddle element that is configured and disposed to create a fluid recirculation zone at the channel. The fluid recirculation zone further inhibits the flow of fluid through the channel.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

The terms "axial" and "axially" as used in this application refer to directions and orientations extending substantially parallel to a center longitudinal axis of a turbomachine. The terms "radial" and "radially" as used in this application refer to directions and orientations extending substantially orthogonally to the center longitudinal axis of the turbomachine. The terms "upstream" and "downstream" as used in this application refer to directions and orientations relative to an axial flow direction with respect to the center longitudinal axis of the turbomachine.

Figure 1:
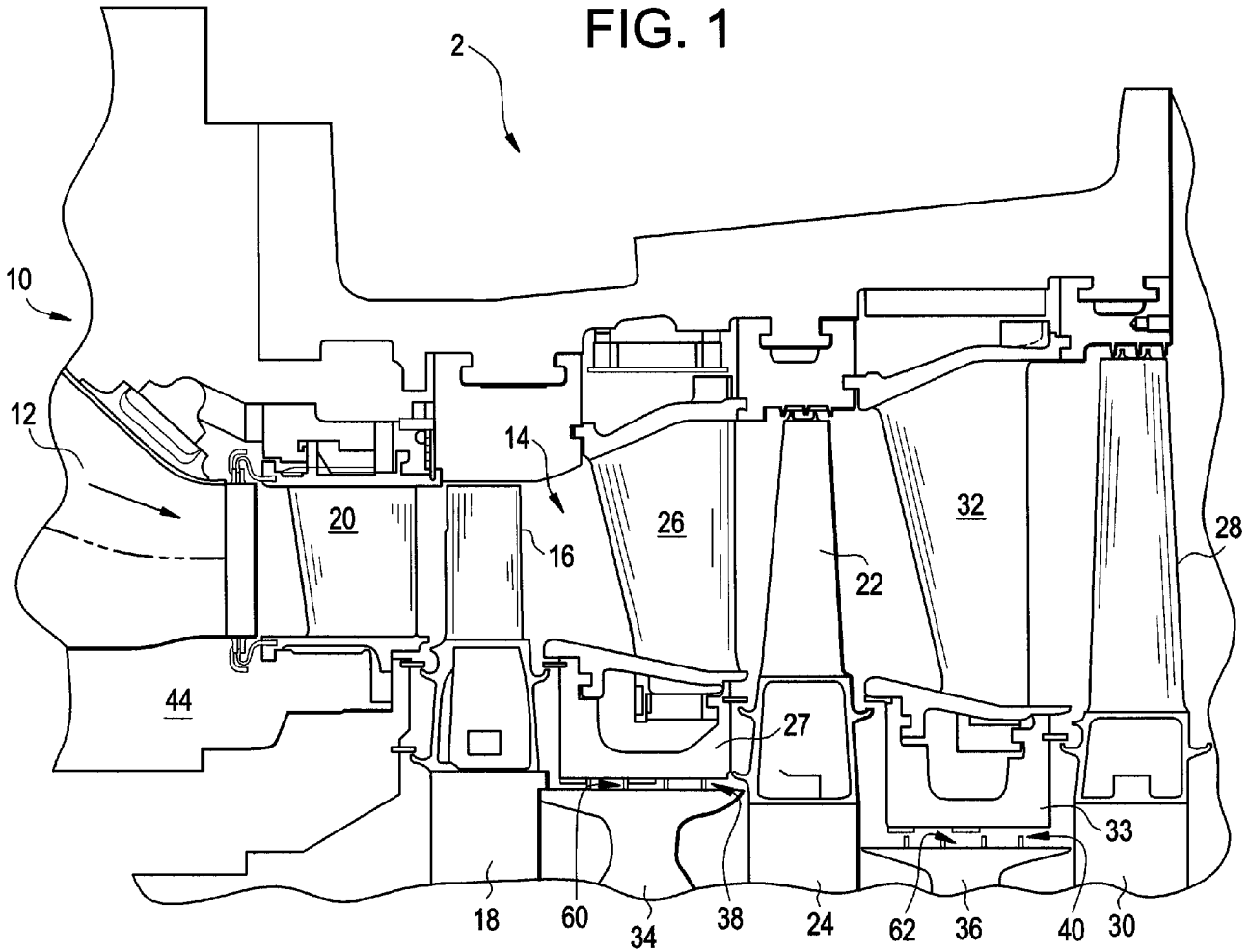
FIG. 1 is a partial cross-sectional side view of a turbomachine including a seal assembly having a paddle element in accordance with an exemplary embodiment.

With reference to FIG. 1, a turbomachine in accordance with an exemplary embodiment is illustrated generally at 2. Turbomachine 2 includes a turbine section 10 that receives hot gases of combustion from an annular array of combustors (not shown). The combustion gases pass through transition piece 12 and flow along a hot gas path 14 toward a number of turbine stages (not separately labeled). Each turbine stage includes a plurality of circumferentially spaced blades and a plurality of circumferentially spaced stator vanes forming an annular array of nozzles. In the exemplary embodiment shown, the first stage of turbine section 10 includes a plurality of circumferentially spaced blades, one of which is indicated at 16, mounted on a first-stage turbine rotor 18 and a plurality of circumferentially spaced-stator vanes, one of which is indicated at 20. Similarly, a second stage of turbine section 10 includes a plurality of blades, one of which is indicated at 22, mounted on a second stage turbine rotor 24 and a plurality circumferentially-spaced stator vanes, one of which is indicated at 26. Turbine section 10 is also shown to includes a third stage having a plurality of circumferentially spaced blades, one of which is indicated at 28, mounted on a third stage turbine rotor 30 and a plurality of circumferentially spaced stator vanes, one of which is indicated at 32.

At this point it should be appreciated that the number of stages present within turbine section 10 can vary. Turbine section 10 also includes a plurality of spacers, two of which are indicated at 34 and 36, rotatably mounted between first, second, and third stage turbine rotors 18, 24 and 30. Spacers 34 and 36 are arranged in a spaced relationship relative to turbine casing members 27 and 33 to define channels 38 and 40 respectively. Finally, it should be appreciated that compressor discharge air is located in a region 44 disposed radially inward of the first turbine stage such that air within region 44 is at a higher pressure than the pressure of the hot gases following along hot gas path 14. At this point it should be understood that the above-described structure is provided for the sake of clarity. The exemplary embodiment is directed to seal assemblies 60 and 62 arranged within channels 38 and 40 respectively. Seal assemblies 60 and 62 constitute labyrinth seals that inhibit fluid flow passing from hot gas path 14 (higher pressure) to region 44 (lower pressure). Fluid flow bypassing the turbine stages and passing from hot gas path 14 will negatively affect an overall efficiency of turbomachine 2.

Figure 2:
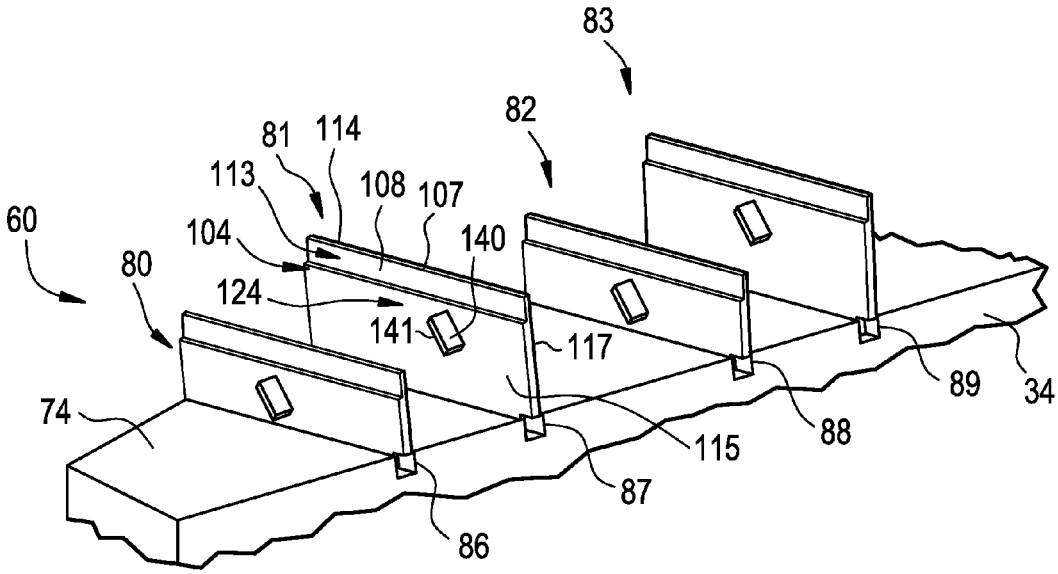
FIG. 2 is a partial, lower left perspective view of the seal assembly of FIG. 1.
Figure 3:
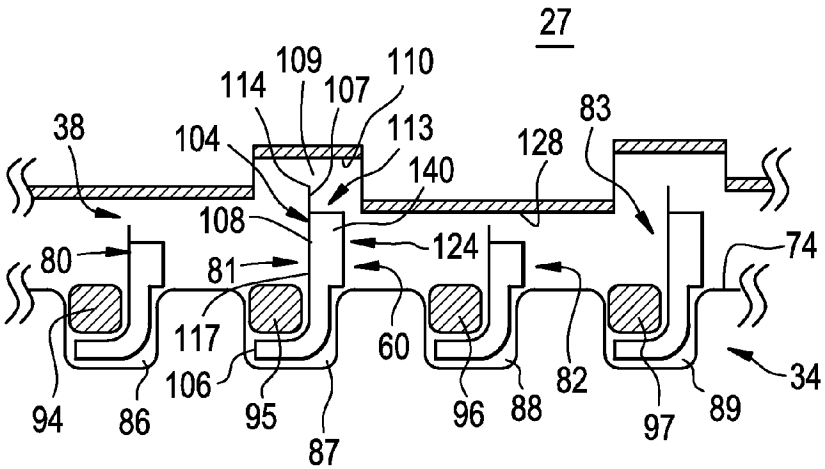
FIG. 3 is an elevational view of the seal assembly of FIG. 2.

As each seal assembly 60, 62 is similarly formed, reference will be made to FIGS. 2-3 in describing seal assembly 60 with an understanding that seal assembly 62 includes corresponding structure. In accordance with an exemplary embodiment, seal assembly 60 is mounted to a surface 74 of spacer 34. Seal assembly 60 includes a plurality of sealing strips 80-83 that are mounted within a corresponding plurality of grooves 86-89 formed in spacer 34. Sealing strips 80-83 are retained within grooves 86-89 by corresponding lengths of caulk wire 94-97. Sealing strip 81 includes a main body 104 having a first or tail end 106 that extends to a second or cantilevered end 107 through an intermediate portion 108 to establish a first length. With this arrangement, second end 107 extends into a recessed region 109 having a surface 110 formed in turbine casing member 27. Main body 104 is formed having a first thickness that extends from first end 106 through intermediate portion 108 and a second or reduced thickness zone 113 that defines a tip portion 114 at second end 107. Main body 104 is also shown to include an upstream surface 115 that is directly exposed to fluid flow in channel 38 and a downstream surface 117. As will be detailed more fully below, upstream surface 115 is provided with a paddle element 124. At this point it should be understood that the remaining sealing strips 80 and 82-83 include similar structure. However, select sealing strips, such as strips 80 and 82, are formed having a second length that is less than the first length. With the second length, sealing strip 82 extends toward a surface 128 of turbine casing 27. With this arrangement, seal assembly 60 defines a labyrinth seal, or a seal that defines a convoluted flow path through channel 38. At this point it should be understood that while shown on upstream surface 115, paddle elements 124 may be arranged on downstream surface 117 or both upstream surface 115 and downstream surface 117.

Figure 4:
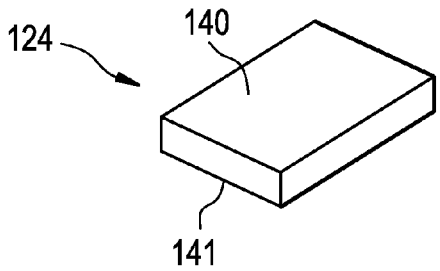
FIG. 4 is a perspective view of a paddle element of the seal assembly of FIG. 2.
Figure 5:
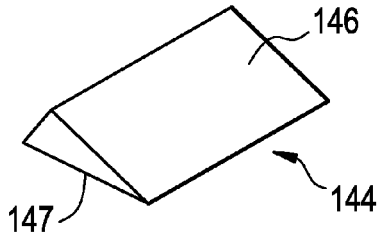
FIG. 5 is a perspective view of a paddle element in accordance with another aspect of the exemplary embodiment.
Figure 6:
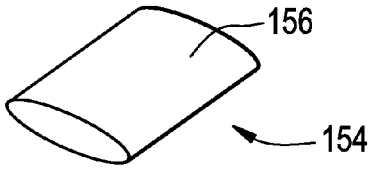
FIG. 6 is a perspective view of a paddle element in accordance with still another aspect of the exemplary embodiment.
Figure 7:
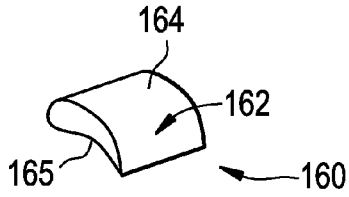
FIG. 7 is a perspective view of a paddle element in accordance with yet another aspect of the exemplary embodiment.

As best shown in FIG. 4, paddle element 124 is formed having a rectangular cross-section including a first surface 140 and an opposing second surface 141. First and second surfaces 140 and 141 create a substantially perpendicular airflow within channel 38. More specifically, first and second surfaces 140 and 141 guide the fluid flow impinging upon upstream surface 115 of the sealing strips 80-83 in a direction that is substantially perpendicular to channel 38. That is, paddle element 124 guides the fluid flow toward a gap (not separately labeled) formed between tip portions 114 and surfaces 110 and 128 forming a fluid recirculation zone. The direction and location of the fluid recirculation zone creates a barrier to the fluid flow passing into channel 38 to enhance a flow inhibiting quality of seal assembly 60. At this point it should be appreciated that seal assembly 60 may include paddle elements having a variety of cross-sections. For example, seal assembly 60 could include a paddle element such as shown at 144 in FIG. 5 having a substantially triangular cross-section. Paddle element 144 includes first and second surfaces 146 and 147 that taper outward to guide the substantially perpendicular airflow at a wider angle. Seal assembly 60 could also include a paddle elements such as shown at 154 in FIG. 6. Paddle element 154 includes a curvilinear cross-section having a continuous outer curvilinear surface 156. Seal assembly 60 may also include paddle elements such as shown at 160 in FIG. 7. Paddle element 160 includes a curvilinear profile 162 having first and second surfaces 164 and 165 that define an airfoil. It should be appreciated that the number, type, shape, and location of the paddle elements can vary not only between various seal assemblies but also between sealing strips in a particular seal assembly depending on various design requirements/parameters.

Figure 8:
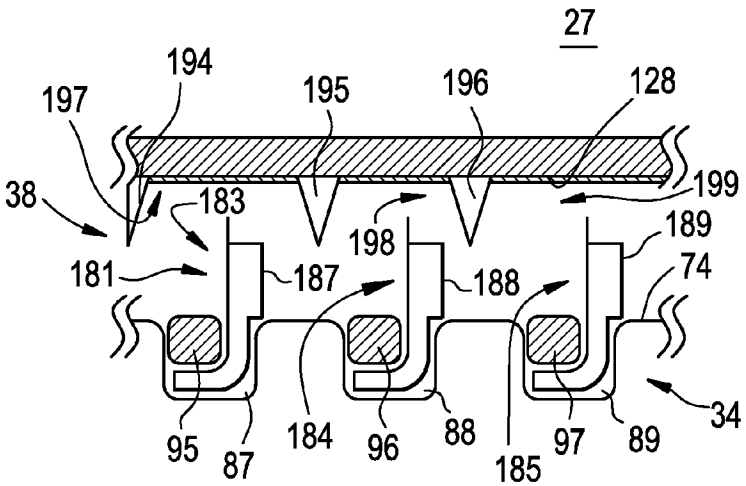
FIG. 8 is an elevational view of a seal assembly in accordance with another aspect of the exemplary embodiment.

Reference will now follow to FIG. 8 in describing a seal assembly 181 in accordance with another exemplary embodiment. Seal assembly 181 includes a plurality of sealing strips 183-185 each having a substantially similar length. Each sealing strip 183-185 includes corresponding paddle elements 187-189. In the exemplary embodiment shown, turbine casing member 27 includes a plurality of projections 194-196 that define a corresponding plurality of recessed regions 197-199. In addition, surface 128 of turbine casing member 27 is provided with an abradable coating (not separately labeled). With this arrangement, tip portions (not separately labeled) of each sealing strip 183-185 will wear away a groove (not shown) in the abradable coating to further reduce any gaps in channel 38. The use of the abradable coating in combination with paddle elements 187-189 further inhibits the passage of fluid flow through channel 38.

Figure 11:
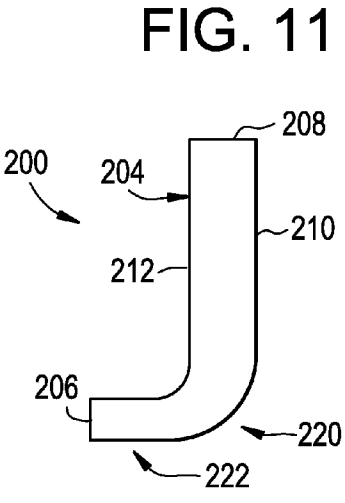
FIG. 11 is a plan view of the sealing strip of FIG. 10 illustrating the reduced thickness zone bent into a tail portion.
Figure 10:
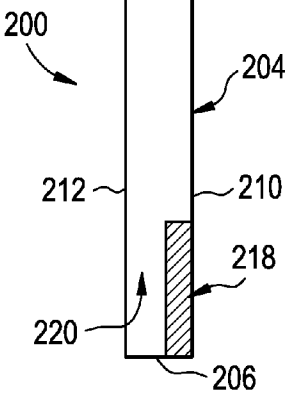
FIG. 10 is a plan view of the sealing strip of FIG. 9 after forming a reduced thickness zone.
Figure 9:
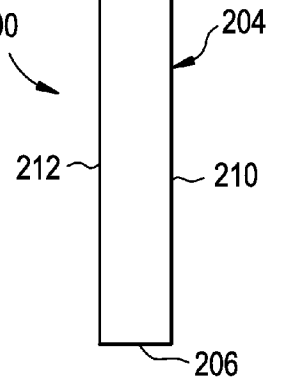
FIG. 9 is a plan view of an un-processed sealing strip in accordance with an exemplary embodiment.
Figure 14:
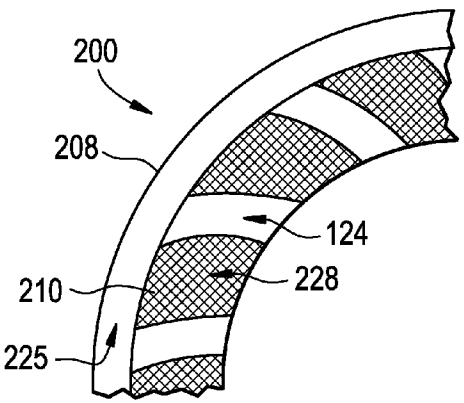
FIG. 14 is a side view of the sealing strip of FIG. 13 illustrating a plurality of paddle elements formed into an upstream surface.
Figure 13:
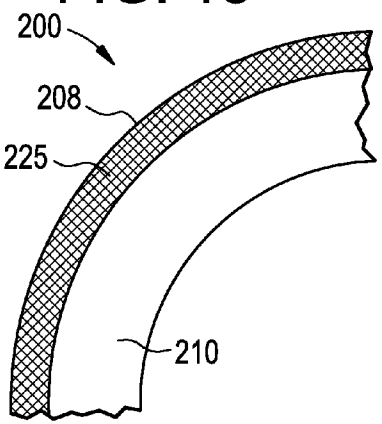
FIG. 13 is a side view of the sealing strip of FIG. 12 after forming a tip portion having a reduced thickness.
Figure 12:
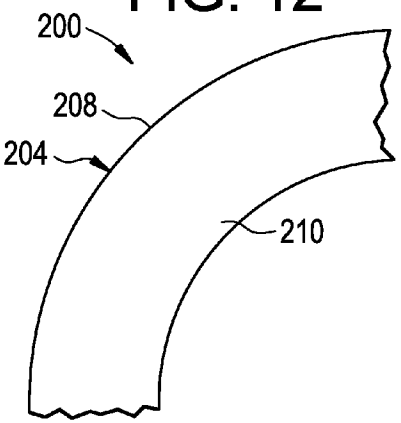
FIG. 12 is a side view of the sealing strip of FIG. 11 formed into a curvilinear shape.

Reference will now be made to FIGS. 9-14 in describing a method of forming a sealing strip 200 in accordance with the exemplary embodiment. An unprocessed sealing strip having a main body 204 including a first end 206 that extends to a second end 208 is prepared for processing as shown in FIG. 9. Main body 204 is positioned to orient an upstream surface 210 and a downstream surface 212 of the sealing strip. At this point, a portion 218 of main body 204 proximate to first end 206 is removed to form a reduced thickness zone 220 such as shown in FIG. 10. FIG. 11 illustrates reduced thickness zone 220 being formed into a tail region 222. At this point it should be understood that the type of material will dictate the need to form the reduced thickness zone 220 prior to forming tail region 222. After forming tail region 222, main body 204 is formed into a curvilinear shape that corresponds to a profile of, for example, spacer 34 such as shown in FIG. 12. Once formed, additional material is removed from main body 204 to form a tip portion 225 at second end 208 such as shown in FIG. 13. Finally, more material is removed from a plurality of regions, one of which is indicated at 228, in upstream surface 210 to form a plurality of paddle elements, one of which is shown at 234.

At this point it should be appreciated that the exemplary embodiments provide a seal assembly that is configured to inhibit fluid flow in a turbomachine between moveable surfaces. The seal assembly inhibits fluid flow by creating a cross flow or recirculation zone at one or more sealing strips. The recirculation zone creates a barrier at tip portions of the sealing strips to further inhibit fluid flow. It should also be appreciated that while shown arranged between a spacer (static member) and a vane (moving member) the seal assembly in accordance with the exemplary embodiment can be installed in locations between variable speed surfaces. Further more, while shown acting as a packing seal, e.g., between surfaces moving at variable speed relative to each other, the seal assembly in accordance with the exemplary embodiment can also be employed to inhibit flow between various other moveable surfaces, including surfaces that are movable translationally, surfaces moveable relative to a static member or surfaces rotating at substantially similar speeds. That is, the seal assembly can be installed in a variety of locations including being employed as blade seals and inter-stage seals. It should be further appreciated that the seal assembly can be installed in a wide range of turbomachine models including gas turbomachines and steam turbomachines.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine seal assembly comprising:

a plurality of sealing strips configured and disposed to inhibit a flow of fluid passing through a channel defined by a first member and a second member, at least one of the plurality of sealing strips extending from a first end to a second end defining a tip portion, the at least one of the plurality of sealing strips including one or more discrete a paddle elements configured and disposed to create a fluid recirculation zone at the channel, the one or more discrete paddle elements guiding a fluid flow impinging upon the at least one of the plurality of sealing strips toward a gap formed between the tip portion and one of the first member and the second member, the fluid recirculation zone inhibiting the flow of fluid through the channel.

2. The turbomachine seal assembly according to claim 1, wherein the at least one of the plurality of sealing strips includes a main body having a first thickness, the main body includes an upstream surface and a downstream surface, the one or more discrete paddle elements being arranged on at least one of the upstream surface and downstream surface.

3. The turbomachine seal assembly according to claim 2, wherein the second end of the one of the plurality of sealing strips includes a reduced thickness zone defining a second thickness that is less than the first thickness.

4. The turbomachine seal assembly according to claim 2, wherein the one or more discrete paddle elements are spaced from the second end portion of the one of the plurality of sealing strips.

5. The turbomachine seal assembly according to claim 1, wherein the one or more discrete paddle elements include a rectangular cross section.

6. The turbomachine seal assembly according to claim 1, wherein the one or more discrete paddle elements include a curvilinear cross section.

7. The turbomachine seal assembly according to claim 6, wherein the curvilinear cross section defines an airfoil.

8. The turbomachine seal assembly according to claim 1, wherein the first member is a static member and the second member is a moveable member.

9. The turbomachine seal assembly according to claim 8, wherein the moveable member is a rotating member.

10. A turbomachine comprising:

a first member;

a second member arranged proximate to the first member;

a channel extending between and defined by the first member and the second member; and a seal assembly mounted to one of the first member and the second member in the channel, the seal assembly including a plurality of sealing strips that extend toward the other of the first member and the second member, the plurality of sealing strips inhibiting a flow of fluid passing through the channel, at least one of the plurality of sealing strips extending from a first end to a second end defining a tip portion, the at least one of the plurality of sealing strips including one or more discrete paddle elements configured and disposed to create a fluid recirculation zone at the channel, the one or more discrete paddle elements guiding a fluid flow impinging upon the at least one of the plurality of sealing strips toward a gap formed between the tip portion and the other of the first member and the second member, the fluid recirculation zone further inhibiting the flow of fluid through the channel.

11. The turbomachine according to claim 10, wherein the first end is mounted to the one of the first member and the second, a main body having a first thickness, the main body includes an upstream surface and a downstream surface, the one or more paddle elements being arranged on at least one of the upstream surface and downstream surface.

12. The turbomachine according to claim 11, wherein the second end portion of the one of the plurality of sealing strips includes a reduced thickness zone defining a second thickness that is less than the first thickness.

13. The turbomachine according to claim 11, wherein the one or more discrete paddle elements are spaced from the second end portion of the one of the plurality of sealing strips.

14. The turbomachine according to claim 10, wherein the one or more discrete paddle elements include a rectangular cross section.

15. The turbomachine according to claim 10, wherein the one or more discrete paddle elements include a curvilinear cross section.

16. The turbomachine according to claim 15, wherein the curvilinear cross section defines an airfoil.

17. The turbomachine according to claim 10, wherein the other of the first member and the second member includes a plurality of projections that define a corresponding plurality of recessed regions, the plurality of sealing strips extending into corresponding ones of the plurality of recessed regions.

18. The turbomachine according to claim 10, wherein the other of the first member and the second member includes at least one recessed region, at least one of the plurality of sealing strips includes a first length and extends into the recessed region and another of the plurality of sealing strips includes a second length that is less than the first length and does not extend into the recessed region.

19. The turbomachine according to claim 10, wherein the other of the first member and the second member includes an abradable coating, the plurality of sealing strips being configured and disposed to contact the abradable coating.

20. The turbomachine according to claim 10, wherein the first member is a static member and the second member is a moveable member.

* * * * *